United States Patent [19]

McMurray

[11] 3,934,363

[45] Jan. 27, 1976

[54] TRENCH BACK FILLING AND COMPACTING APPARATUS

[76] Inventor: Russell L. McMurray, R.R. No. 2, Du Quoin, Ill. 62832

[22] Filed: Aug. 30, 1974

[21] Appl. No.: 502,004

[52] U.S. Cl. ..... 37/82; 37/142.5

[51] Int. Cl.[2] ..... E02F 5/04; E02F 5/22

[58] Field of Search ..... 37/142.5, 8, 9, 82, DIG. 3

[56] References Cited

UNITED STATES PATENTS

| | | | |
|---|---|---|---|
| 684,762 | 10/1901 | Taylor | 37/82 |
| 2,646,736 | 7/1953 | Swartout | 37/82 X |
| 2,714,775 | 8/1955 | Crawford | 37/142.5 |
| 3,091,873 | 6/1963 | West | 37/142.5 |
| 3,533,174 | 10/1970 | Carston | 37/8 |
| 3,596,384 | 8/1971 | Neujahr | 37/142.5 |

*Primary Examiner*—Stephen C. Pellegrino
*Attorney, Agent, or Firm*—Woodard, Weikart, Emhardt & Naughton

[57] ABSTRACT

An apparatus for filling a trench and compacting the dirt within the trench. A vertical auger is rotatably mounted on a frame and is positionable within the trench for compacting dirt within the trench. A horizontal auger is rotatably mounted to the frame and includes a pair of flights spiraling toward the vertical auger on opposite sides of the vertical auger to force dirt along opposite sides of the trench into the trench with the dirt then being compacted by the vertical auger. Means are provided for rotating the horizontal and vertical augers. Additional means are provided for raising and lowering the vertical auger into and out of the trench. The vertical auger is pivotally mounted to the frame and may be pivoted upwardly when not in use by a third means. Back-up plates are provided to limit the movement of dirt away from the vertical and horizontal augers. The apparatus is mountable to a powered vehicle, such as a tractor.

7 Claims, 5 Drawing Figures

TRENCH BACK FILLING AND COMPACTING APPARATUS

BACKGROUND OF THE INVENTION

1. Field of the Invention

This invention is in the field of ditch digging and refilling devices.

2. Description of the Prior Art

A number of machines have been designed for filling a trench or ditch. A representative sample of the prior art is disclosed in the following U.S. Pat. Nos.:

1,563,975 issued to C. F. Goeringer;
1,677,342 issued to J. H. Hodgen;
1,807,489 issued to W. V. Middleton et al.;
2,714,775 issued to L. A. Crawford;
2,857,691 issued to D. M. Curran;
3,091,873 issued to B. B. West;
3,119,193 issued to E. D. Herschberger; and
3,181,258 issued to W. W. Duncan.

Generally the prior art devices shown in the aforementioned patents include a horizontal auger which is rotated to propel the dirt along one side of the trench into the trench. In actual practice, dirt may line both sides of the trench thereby requiring the operator to first drive one of the prior art machines along one side of the trench to propel the dirt into the trench and to then drive the machine along the opposite side of the trench to force the remaining dirt into the trench. Disclosed herein is a trench filling device which includes a pair of augers having flights positioned on the opposite sides of the trench to simultaneously propel the dirt along the opposite sides of the trench into the trench. Thus, the time required to fill the trench may be reduced by approximately one-half as compared to the prior art machines.

It is desirable to compact the dirt forced into the trench in order to prevent voids and air pockets thereby minimizing sinking or settling of the dirt within the trench. Thus, various devices have been provided to propel the dirt into the trench and to subsequently compact the dirt within the trench. The U.S. Pat. Nos. 1,684,882 and 1,947,356 issued to A. J. Penote disclose a combined filler and tamping device for compacting the dirt within the trench. Two other devices are disclosed in the U.S. Pat. Nos. 2,891,335 issued to F. H. Linneman and 3,471,953 issued to H. M. Wyatt both of which disclose a rotatably mounted tamping wheel. Another device of interest is disclosed in U.S. Pat. No. 3,596,384 issued to R. E. Neujahr which discloses an evacuation refill packer. Disclosed herein is a new back filling and compacting apparatus which includes the previously described horizontal auger with a vertical auger extending beneath the horizontal auger to compact the dirt within the trench. The vertical auger carries the dirt to the bottom of the trench whereat the dirt is tightly compacted against the bottom of the trench as compared to the prior art devices which do not carry the dirt to the bottom of the trench but instead tamp or force the dirt against the ground.

SUMMARY OF THE INVENTION

One embodiment of the present invention is an apparatus for forcing dirt along opposite sides of a trench into the trench and then compacting the dirt within the trench comprising a frame, a vertical auger rotatably mounted on the frame, a horizontal auger rotatably mounted to the frame and including a first flight spiraling toward the vertical auger and a second flight spiraling toward the vertical auger from a side of the vertical auger opposite the first flight to propel dirt from opposite sides of the trench toward the vertical auger, and first means connected to the vertical auger and the horizontal auger operable to rotate the horizontal auger propelling dirt into the trench and to rotate the vertical auger to compact dirt within the trench.

It is an object of the present invention to provide a new and improved apparatus for filling a trench with dirt and subsequently packing the dirt within the trench.

Yet another object of the present invention is to provide a trench back filling and compacting apparatus incorporating a horizontal extending auger and a vertically extending auger.

Likewise, it is an object of the present invention to provide a trench back filling apparatus having means for simultaneously propelling dirt along opposite sides of the trench into the trench.

Related objects and advantages of the present invention will be apparent from the following description.

DESCRIPTION OF THE PREFERRED EMBODIMENT

Figure 1:
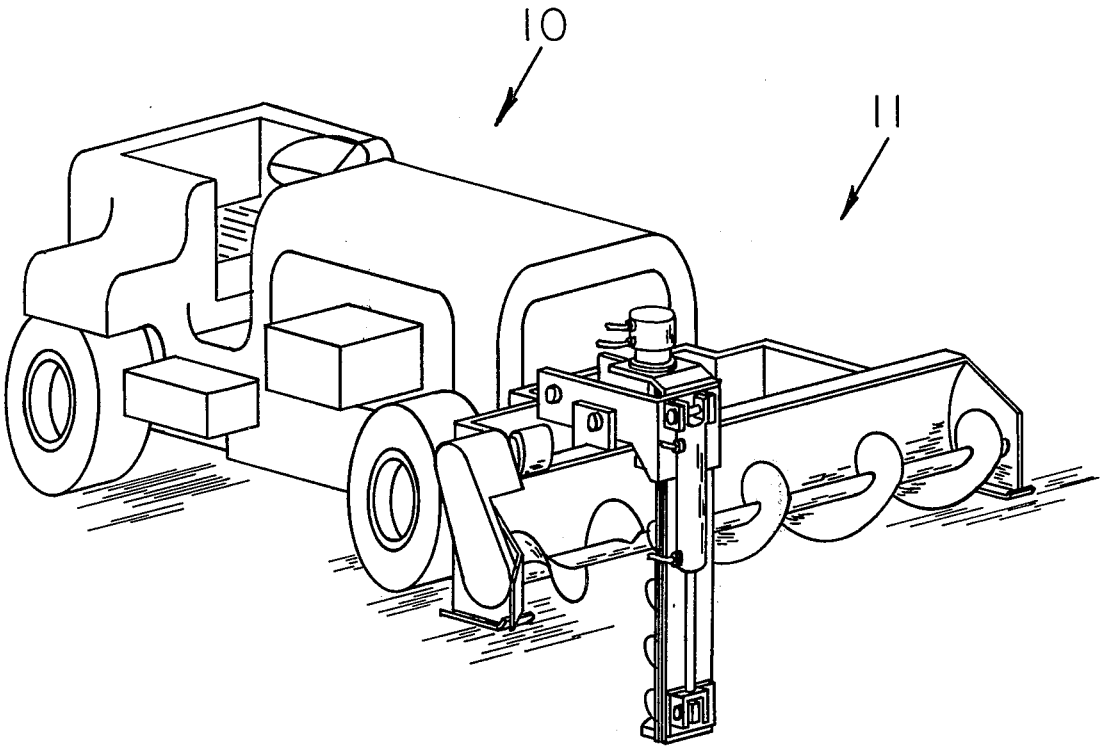
FIG. 1 is a perspective view of an apparatus incorporating the present invention shown mounted to a tractor.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
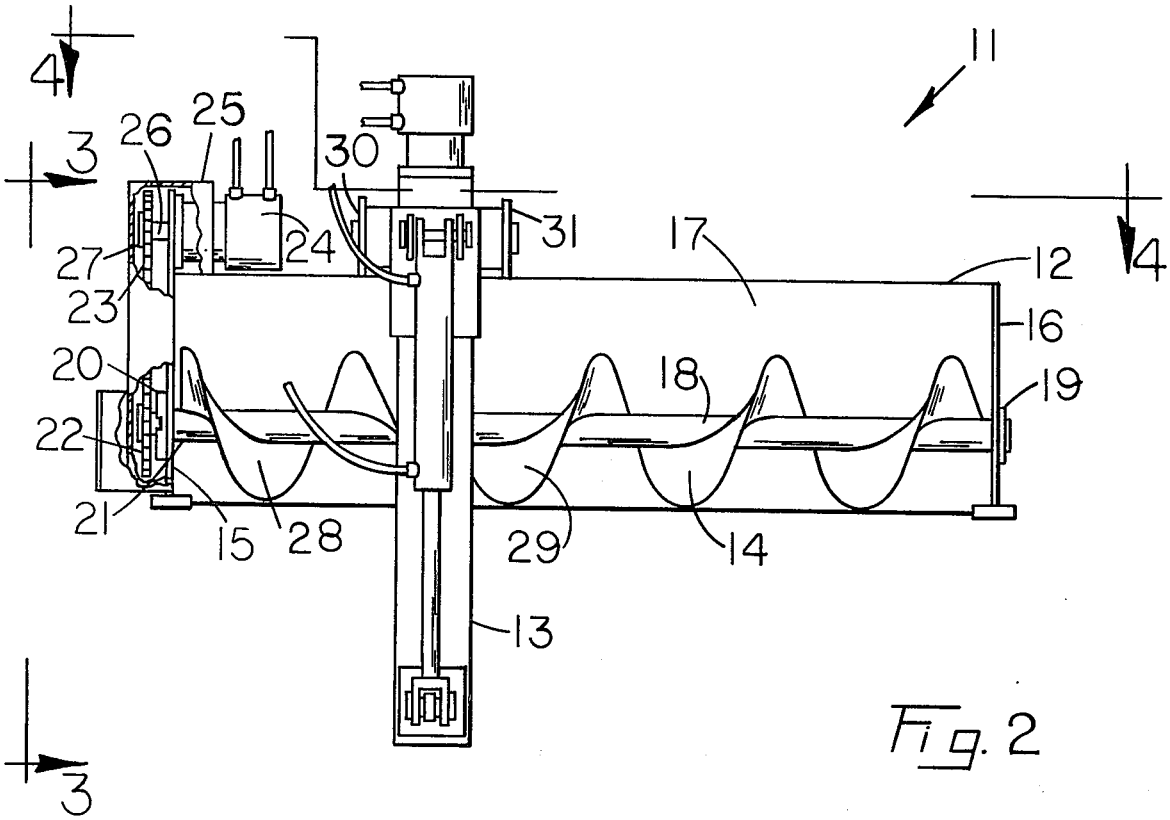
FIG. 2 is a fragmentary enlarged front view of the apparatus shown in FIG. 1.

Referring now more particularly to FIG. 1, there is shown a conventional tractor 10 with the apparatus 11 incorporating the present invention mounted to the front of the tractor. Apparatus 11 is used to force dirt along opposite sides of a ditch into the ditch and to then subsequently compact the dirt within the ditch. Apparatus 11 includes a main frame 12 (FIG. 2) having a vertical auger 13 and a horizontal auger 14 rotatably mounted thereon.

Frame 12 includes a pair of end plates 15 and 16 fixedly mounted to a back-up plate 17 which extends behind auger 14. Axle 18 is rotatably mounted to flange bearings 19 and 20 in turn mounted to end plates 16 and 15. End 21 of axle 18 has a sprocket 22 fastened thereto in meshing engagement with continuous roller chain 23. Hydraulic motor 24 is mounted to bracket 25 fastened to back-up plate 17. The output shaft 26 of motor 24 has a sprocket 27 mounted thereon in meshing engagement with roller chain 23. Operation of motor 24 results in movement of chain 23 and rotation of axle 18.

Axle 18 has two separate flights 28 and 29 fixedly mounted thereon. Flight 29 extends around axle 18 so as to propel dirt from end plate 16 toward vertical auger 13 while flight 28 simultaneously propels dirt from end plate 15 toward the vertical auger 13 all while axle 18 is rotating in the same direction. Viewing axle 18 from end plate 15 and looking toward auger 13, flight 29 spirals in a clockwise direction and extends from plate 16 toward the vertical auger. Likewise, viewing axle 18 from end plate 16 and looking toward the vertical auger, flight 28 extends around axle 18 in a clockwise direction extending from the end plate 15 toward the vertical auger. Tractor 10 may therefore be driven along the length of the trench with flight 29 extending across one side of the trench and with flight 28 extending across the opposite side of the trench. The dirt positioned on the opposite sides of the trench are therefore propelled into the trench.

Figure 3:
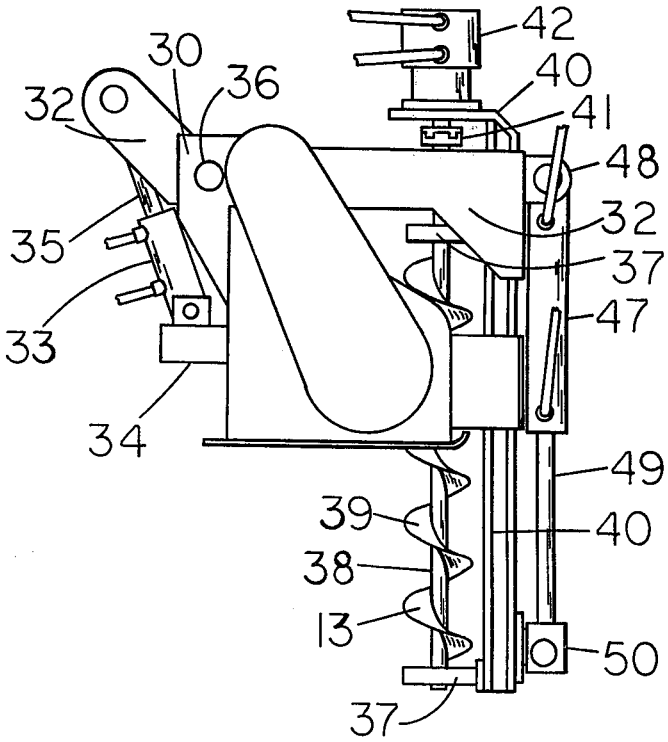
FIG. 3 is an end view looking in the direction of arrows 3—3 of FIG. 2.

Fixedly mounted to back-up plate 17 are a pair of brackets 30 and 31 having a vertical auger mounting assembly 32 pivotally mounted thereto. A hydraulic cylinder 33 has a bottom end pivotally mounted to bracket 34 secured to back-up plate 17. The extendable piston rod 35 of cylinder 33 is pivotally mounted to mounting assembly 32 which is pivotable above pivot pin 36 (FIG. 3).

Figure 4:
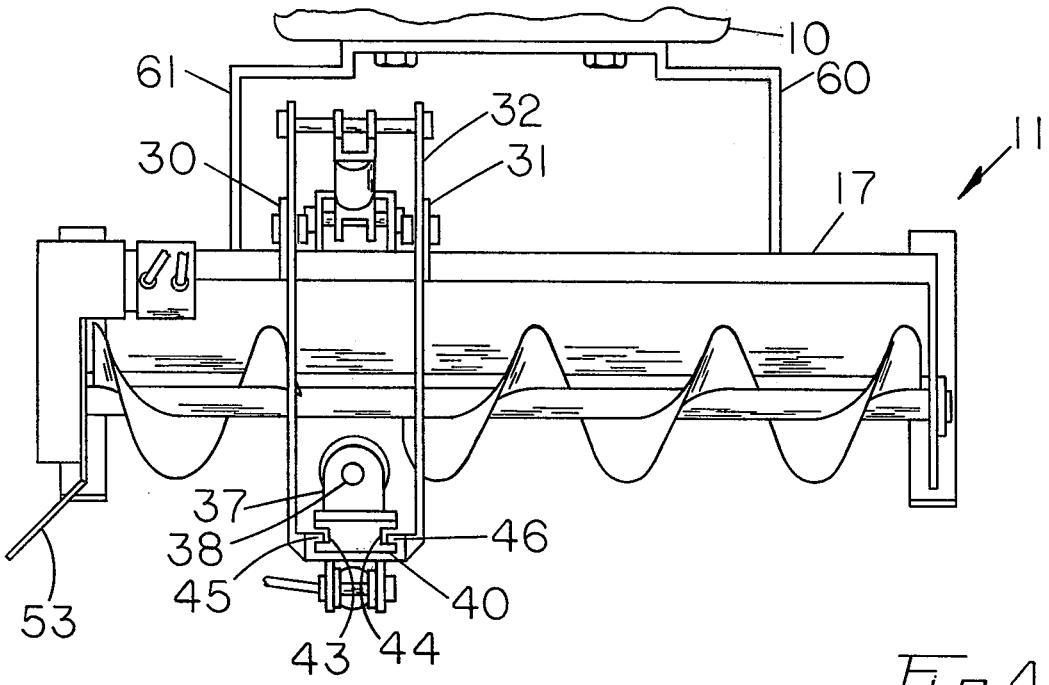
FIG. 4 is a cross sectional view taken along the line 4—4 of FIG. 2 and viewed in the direction of the arrows.

Several mounting blocks 37 (FIG. 3) are fixedly mounted to a vertically extending plate 40 slidably mounted to mounting assembly 32. Axle 38 of auger 13 is rotatably mounted to mounting blocks 37. A single flight 39 extends spiralingly around axle 38 in a clockwise direction as viewed from the end of auger 13. The top of the auger is connected by coupling 41 to hydraulic motor 42 fixedly mounted to slide 40. Slide 40 is provided with a pair of grooves 43 and 44 (FIG. 4) extending in its opposite edges with the grooves slidably receiving a pair of ridges 45 and 46 formed within mounting assembly 32. Hydraulic cylinder motor 47 (FIG. 3) has a top end pivotally mounted to bracket 48 secured to mounting assembly 32. The extendable piston rod 49 of cylinder 47 is pivotally mounted by bracket 50 to the bottom end of slide 40. Thus, by extending rod 49 the auger is caused to move downwardly into the trench whereas by retracting rod 49 the vertical auger is caused to move upwardly out of the trench.

Back-up plate 17 (FIG. 2) extends the length of the horizontal auger so as to force dirt into the auger as the apparatus is moved along the length of the trench. Likewise, slide 40 provides a back-up plate for the vertical auger which is positioned between the back-up plate 17 and slide 40 thereby forcing the dirt onto the vertically extending auger. Wall 53 (FIG. 4) is fixedly mounted to end plate 15 extending outwardly from auger 14 and away from the vertical auger providing a guide for the dirt to be forced into the horizontally extending auger. The vertical auger is mounted between the back-up plate and slide 40 to compact the dirt within the trench after the dirt has been forced into the trench by the horizontally extending auger.

Apparatus 11 may be mounted to a vehicle by a variety of different structures. For example, a pair of brackets 60 and 61 (FIG. 4) may be mounted to the back-up plate 17 and in turn secured to the front of tractor 10.

Figure 5:
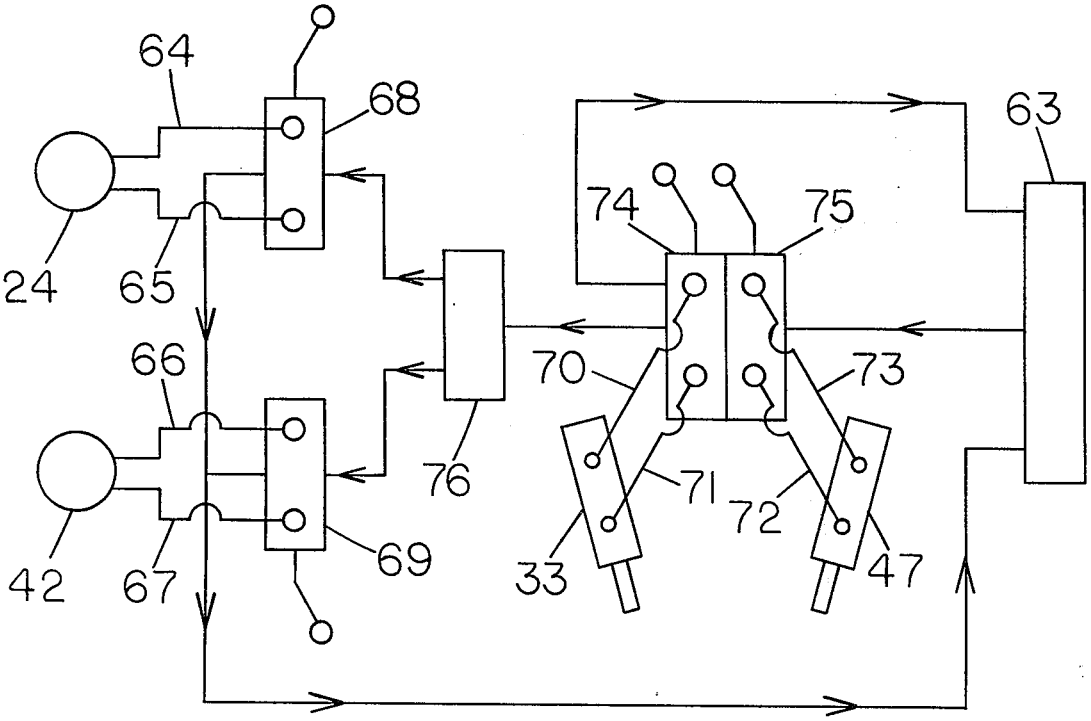
FIG. 5 is a schematic representation of the hydraulic system of the apparatus incorporating the present invention.

In the embodiment shown in the drawing, a single source of hydraulic fluid 63 (FIG. 5) is connected to motors 24 and 42 respectively by hydraulic lines 64, 65 and 66 and 67. Valves 68 and 69 are provided to control the flow of hydraulic pressure to the motors for driving the augers with the pressurized fluid being divided by flow divider 76 and directed to valves 68 and 69. Likewise, cylinders 33 and 47 are connected by lines 70, 71 and 72, 73 with valves 74 and 75 being provided to control the application of hydraulic pressure to retract or withdraw the piston rods of the cylinders.

By using a fairly high speed vertical auger positioned within the trench, the dirt is forced completely to the bottom of the trench against the dirt already placed within the trench. The oppositely spiraling flights on the horizontal auger propel the dirt on opposite sides of the trench together and into the trench. Thus, all voids and air pockets are prevented minimizing subsequent settling of the dirt within the trench.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An apparatus for forcing dirt along opposite sides of a trench into the trench and then compacting the dirt within the trench comprising:

a frame;

a vertical auger rotatably mounted on said frame;

a horizontal auger rotatably mounted to said frame and including a first flight spiraling toward said vertical auger and a second flight spiraling toward said vertical auger from a side of said vertical auger opposite said first flight to propel dirt from opposite sides of said trench toward said vertical auger, said frame including a back-up wall positioned adjacent said horizontal auger forcing dirt into said horizontal auger, said frame further including another wall positioned adjacent said vertical auger forcing dirt into said vertical auger;

first means connected to said vertical auger and said horizontal auger operable to rotate said horizontal auger propelling dirt into said trench and to rotate said vertical auger to compact dirt within said trench;

second means connected to said frame and said vertical auger operable to raise and lower said vertical auger into and out of said trench.

2. The apparatus of claim 1 wherein:

said first means includes a first fluid motor drivingly connected to said horizontal auger, a second fluid motor drivingly connected to said vertical auger and a source of fluid pressure connected to said first motor and said second motor.

3. An apparatus for forcing dirt along opposite sides of a trench into the trench and then compacting the dirt within the trench comprising:

a frame;

a vertical auger rotatably mounted on said frame;

a horizontal auger rotatably mounted to said frame and including a first flight spiraling toward said vertical auger and a second flight spiraling toward said vertical auger from a side of said vertical auger opposite said first flight to propel dirt from opposite sides of said trench toward said vertical auger;

first means connected to said vertical auger and said horizontal auger operable to rotate said horizontal auger propelling dirt into said trench and to rotate said vertical auger to compact dirt within said trench; and wherein:

said first means includes a first fluid motor drivingly connected to said horizontal auger, a second fluid motor drivingly connected to said vertical auger and a source of fluid pressure connected to said first motor and said second motor;

second means connected to said frame and said vertical auger operable to raise and lower said vertical auger into and out of said trench;

said frame includes a back-up plate extending the length of said horizontal auger forcing dirt into said horizontal auger, said frame further includes a guide pivotally mounted to said back-up plate and a vertically extending mounting wall slidably mounted to said guide, said vertical auger is mounted to said vertically extending mounting wall with said second means including a fluid cylinder connected to and between said guide and said mounting wall.

4. The apparatus of claim 3 wherein:

said vertical auger is positioned between said back-up plate and said vertically extending mounting wall with said vertically extending mounting wall and said back-up plate limiting movement of said dirt.

5. The apparatus of claim 4 and further comprising:

third means connected to and between said back-up plate and said guide operable to pivot said guide to swing said vertical auger upwardly.

6. The apparatus of claim 1 and further comprising:

a powered vehicle having said apparatus mounted thereon.

7. The apparatus of claim 6 and further comprising:

said first means includes a first fluid motor drivingly connected to said horizontal auger, a second fluid motor drivingly connected to said vertical auger and a source of fluid pressure connected to said first motor and said second motor.

* * * * *